US005802896A

United States Patent [19]

Tsai

[11] Patent Number: 5,802,896

[45] Date of Patent: Sep. 8, 1998

[54] SAFETY LOCK-SET

[76] Inventor: Ching-Tien Tsai, No. 3, Lane 288, Hsi-Shu Rd., Tainan, Taiwan

[21] Appl. No.: 852,339

[22] Filed: May 7, 1997

[51] Int. Cl.[6] ..... E05B 15/16

[52] U.S. Cl. ..... 70/417; 70/DIG. 43; 292/337

[58] Field of Search ..... 70/417, 209, 1.5, 70/416, 418, DIG. 43, DIG. 56; 292/337

[56] References Cited

U.S. PATENT DOCUMENTS

| | | | |
|---|---|---|---|
| 4,183,235 | 1/1980 | Coralli et al. | 70/417 X |
| 4,338,804 | 7/1982 | Solovieff | 70/417 X |
| 4,587,816 | 5/1986 | Garcia | 70/417 |
| 5,255,544 | 10/1993 | Wu | 70/417 X |
| 5,316,353 | 5/1994 | McKernan | 70/417 X |

FOREIGN PATENT DOCUMENTS

| | | | |
|---|---|---|---|
| 377447 | 6/1923 | Germany | 70/417 |
| 620268 | 11/1980 | Switzerland | 70/417 |
| 680380 | 8/1992 | Switzerland | 70/417 |

*Primary Examiner*—Lloyd A. Gall

*Attorney, Agent, or Firm*—Morton J. Rosenberg; David I. Klein; Jun Y. Lee

[57] ABSTRACT

A safety lock-set is provided which includes a main body, a socket and a bushing. The heat-treated socket is used not only to close off the lock-pin hole of the main body, but also to form a skirt for the spring and the back end of the latch. The heat-treated bushing is provided to sleeve over the connecting area of the set bar and the latch from the lock barrel side. The socket and the bushing connect together with a respective curved notch on each one, to form a closed connecting sleeve to protect the connecting areas of the latch and the spring and the set bar, in order to prevent someone from drilling through the lock-set.

1 Claim, 3 Drawing Sheets

SAFETY LOCK-SET

BACKGROUND OF THE INVENTION

1. Field of the Invention

The present invention relates to a safety lock-set, and more particularly to a sturdy lock-set having a lower production cost.

2. Prior Art

A conventional safety lock-set, as shown in FIG. 4, is made of a lightweight material such as Kirksite, in which a main body A has a lock-pin hole A1 and a hollow cylinder A2 intersecting and in open communication with each other. A latch E backing on to a spring F is placed in the lock-pin hole A1. A lock barrel D is disposed in the hollow cylinder A2 so that the latch E is controlled by the lock barrel D. A chock B seals off one open end of the lock-pin hole Al. Because the Kirksite material is so soft that drilling a hole behind the latch E is not difficult, to open the lock, a heat-treated chock C is applied to block the area behind the back of the latch E. However, other places, like the interface between the latch E and the spring F and the lock barrel D, become the target sites for destroying the lock. Through those sites, the latch E can be moved with a thin rigid bar, so that the locking bar can be drawn out. As a solution to this problem, a lock-set with a heat-treated steel main body has been produced to improve the strength and safety of the lock, but the production cost and the weight are increased so that it is not convenient to use.

SUMMARY OF THE INVENTION

It is therefore one object of this invention to provide a lock-set that not only has a low production cost and a weight as light as a lock-set formed from Kirksite, but also the structure as sturdy as that of heat-treated steel.

The present invention includes a main body, a socket and a bushing, in which the heat-treated socket is applied not only to block the lock-pin hole of the main body, but also to skirt the spring and the back end of the latch. The heat-treated bushing sleeves the connecting area of the set bar and the latch from the lock barrel side. The socket and the bushing connect together with a curved notch on each one to form a closed connecting sleeve to protect the connecting areas of the latch and the spring and the set bar, in order to prevent the lock-set from being drilled through.

DETAILED DESCRIPTION OF THE PREFERRED EMBODIMENTS

Figure 1:
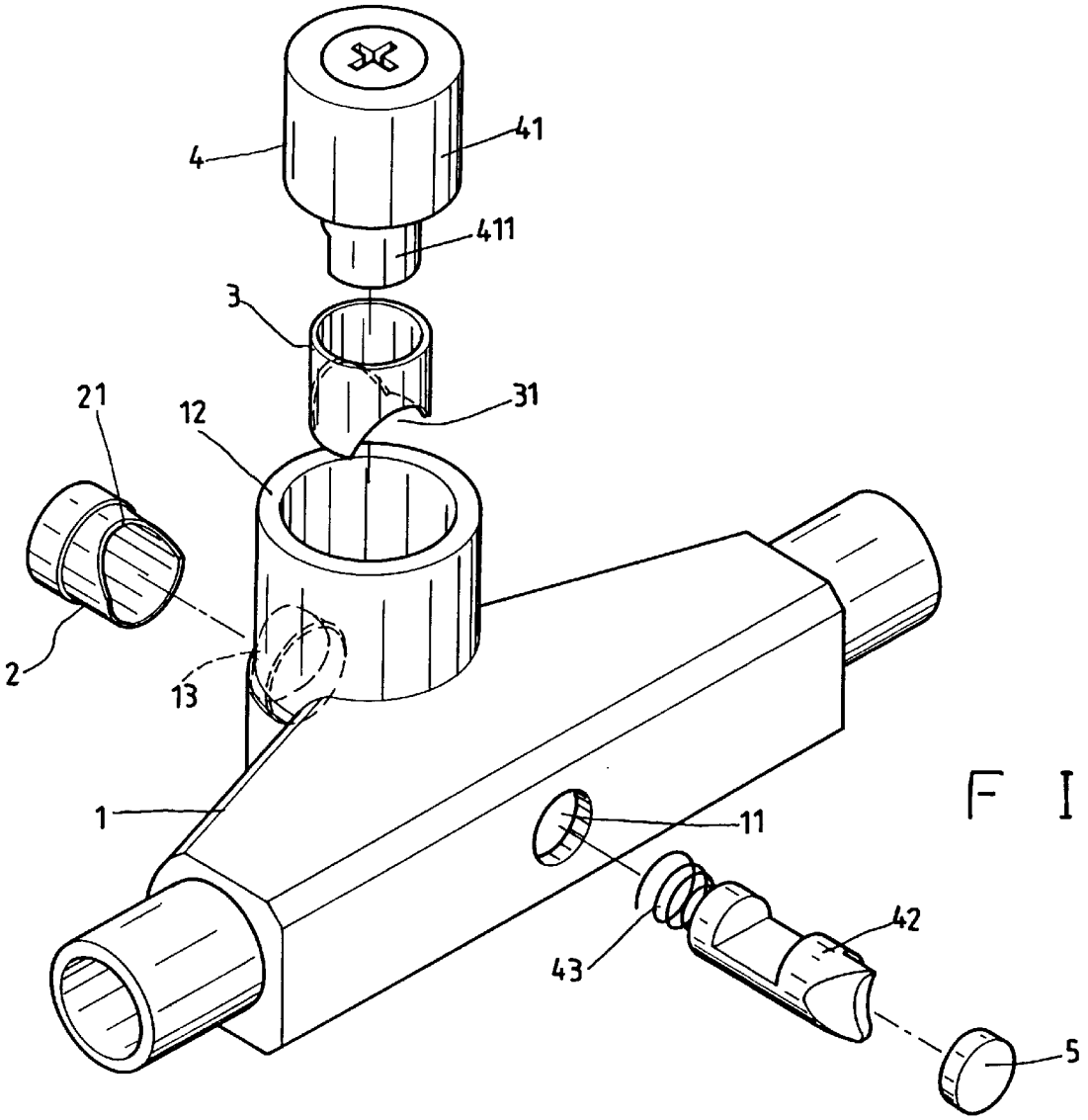
FIG. 1 is an exploded view of the present invention.

Referring to FIG. 1, the present invention includes a main body 1, a socket 2 and a bushing 3, cooperating with a lock unit 4.

The main body 1 has a lock-pin hole 11 at a bottom side, and a hollow cylinder 12 intersecting the lock-pin hole 11 near the back end of the main body. A rabbet 13 is formed at the back end of said lock-pin hole 11.

The socket 2 has a closed end and an open end with an arcuate notch 21 formed in a perimeter edge thereof.

The bushing 3 is a heat-treated hollow tube having a diameter the same as a diameter of a mating portion of the socket 2, in which one end has a perimeter edge with a notch 31 formed therein.

Figure 2:
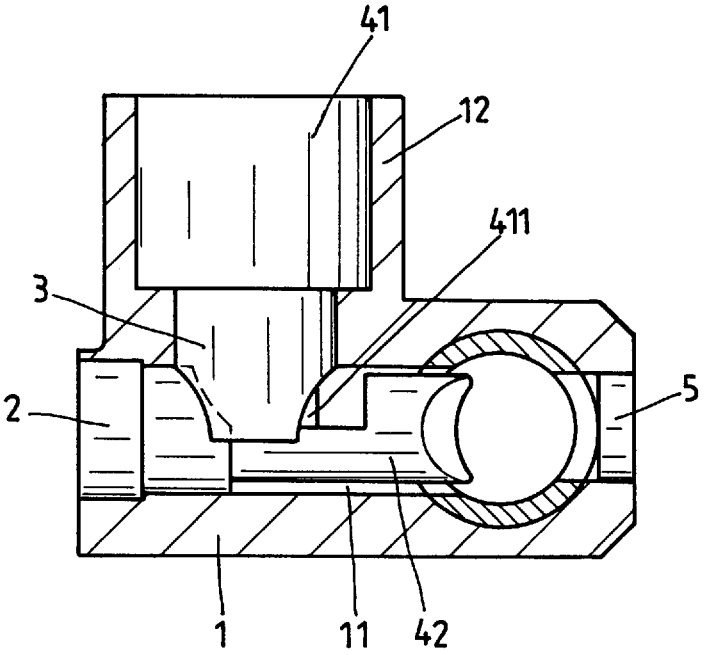
FIG. 2 is a cross-section view of the present invention.
Figure 3:
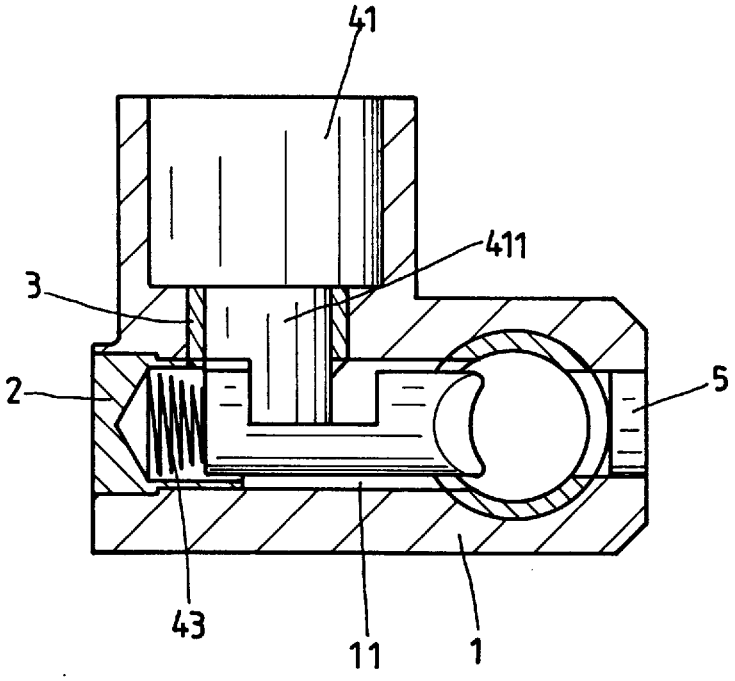
FIG. 3 is a cross-section view of the present invention.
Figure 4:
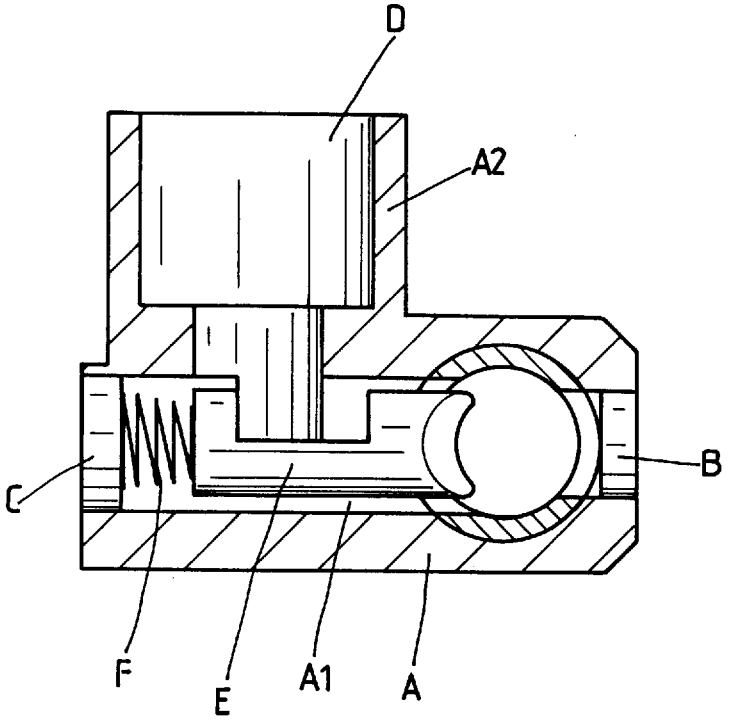
FIG. 4 (PRIOR ART)
FIG. 4 is a cross-section view of a prior art.

In combination, referring to FIG. 2 and FIG. 3, a latch 42 and a lock barrel 41, with the bushing 3 at the bottom portion of the hollow cylinder 12, are plugged into the lock-pin hole 11 and the hollow cylinger 12, respectively, so that a set bar 411 of the lock barrel 41 inserts into the slot of the latch 42 and are sleeved by the bushing 3. The socket 2 is pressed into the lock-pin hole 11 from the rear end of the main body, so that the spring 43 that is at the back end of the latch 42 is sleeved by the socket 2. The socket 2 covers the spring 43 and the back end of the latch 42 and contacts the bushing 3 with the notches 21 and 31 being brought together. By that arrangement, all the areas adjacent to the set bar and rear end of the latch are protected by the heat-treated socket 2 and the heat-treated bushing 3. The socket 2 and bushing 3 are so hard that drilling through them is very difficult. The socket 2 and the bushing 3 are fixed in the places tightly, such that they cannot be pried apart.

I claim:

1. A safety lock-set, comprising:

a main body having a lock-pin hole formed therethrough adjacent a bottom side thereof and a transversely directed hollow cylinder intersecting a rear end of said lock-pin hole and in open communication therewith;

a socket member formed of heat-treated steel and disposed in said rear end of said lock-pin hole to form a closure therefor, said socket member having a closed end and an opposing open end to define a cavity therein, said open end having an arcuate shaped notch formed in a perimeter edge thereof;

a spring disposed in said cavity of said socket member;

a latch disposed in said lock-pin hole and having a rear end surface in contiguous contact with one end of said spring within said cavity of said socket member;

a lock barrel disposed in said hollow cylinder and having a set bar extending therefrom for displaceably engaging said latch;

a heat-treated steel bushing having a tubular contour disposed in said hollow cylinder and surrounding said set bar, said bushing having a distal end with arcuate notches formed in a perimeter edge thereof, said distal end of said bushing contacting said socket member with respective arcuate notches being disposed in aligned relationship, said socket member and said bushing together forming a shield around said set bar, said spring and a rear end portion of said latch.

* * * * *